United States Patent [19]

Sato et al.

[11] 4,442,027

[45] Apr. 10, 1984

[54] ELECTRICAL INSULATING OIL COMPOSITION

[75] Inventors: Atsushi Sato, Tokyo; Naoya Takahashi, Yokohama; Keiji Endo, Yokohama; Hitoshi Yanagishita, Yokohama, all of Japan

[73] Assignee: Nippon Petrochemicals Company Ltd., Tokyo, Japan

[21] Appl. No.: 511,728

[22] Filed: Jul. 8, 1983

Related U.S. Application Data

[63] Continuation of Ser. No. 300,503, Sep. 9, 1981, abandoned.

[30] Foreign Application Priority Data

Sep. 11, 1980 [JP] Japan ..... 55-126489

[51] Int. Cl.[3] ..... H01B 3/22

[52] U.S. Cl. ..... 252/574; 252/45; 252/570; 208/14; 208/109; 208/134; 585/6.6

[58] Field of Search ..... 252/45, 570, 574; 208/14, 109, 134; 585/6.6

[56] References Cited

U.S. PATENT DOCUMENTS

| | | | |
|---|---|---|---|
| 2,199,108 | 4/1940 | Loane et al. | 208/14 |
| 2,288,373 | 6/1942 | Smith et al. | 174/25 |
| 3,759,817 | 9/1973 | Mills et al. | 208/14 |
| 3,811,077 | 5/1974 | Munch | 317/258 |
| 4,175,278 | 11/1979 | Sato et al. | 361/315 |

OTHER PUBLICATIONS

V. Kalichevsky and K. Kobe, *Petroleum Refining with Chemicals,* Amsterdam, Elsevier, 1956, pp. 15–16 and 249–251.

M. Popovich and C. Hering, *Fuels and Lubricants,* N.Y., John Wiley & Sons, 1959, pp. 72, 154 and 206.

*Primary Examiner*—John E. Kittle
*Assistant Examiner*—Robert A. Wax
*Attorney, Agent, or Firm*—Scully, Scott, Murphy & Presser

[57] ABSTRACT

An electrical insulating oil composition which is characterized in that said insulating oil composition contains 5 to 300 ppm (as sulfur) of sulfur compounds and exerts excellent deterioration resistance when the insulating oil composition is fed through or used in contact with a substance made of lead or a lead alloy.

4 Claims, No Drawings

ELECTRICAL INSULATING OIL COMPOSITION

This application is a continuation, of application Ser. No. 300,503, filed Sept. 9, 1981, now abandoned.

BACKGROUND OF THE INVENTION (1) Field of the Invention

This invention relates to a novel electrical insulating oil composition. More particularly, the invention relates to an improved electrical insulating oil composition which exerts excellent deterioration resistance when it is brought into contact with substances made of lead or lead alloy.

(2) Description of the Prior Art

The electrical insulating oil is used for oil-filled or oil-impregnated electrical appliances and lead is used as a material for component parts of these electrical appliances.

For instance, in the case of oil-impregnated cables such as oil-filled cables and pipe-type oil-filled cables, they are commonly covered by lead or lead alloy material partly for preventing the impregnating electrical insulating oil from leaking. Further, included in the foregoing electrical appliances are oil-filled electrical capacitors and oil-filled transformers in which lead is used as a material for their component parts. For example, in the case of oil-filled capacitors, the oil supply tubes for filling oil into capacitors are made of lead and the lead tubes are pinched and cut off after the oil filling operation. As a result, certain portions of lead tubes remain within the capacitors, which tubes come into contact with the insulating oil. The component parts made of lead include such lead tubes.

When electric insulating oils are kept in contact with lead material, thermal deterioration and oxidation occur and, in some insulating oils, the degree of deterioration is too severe for practical use. This tendency can be observed in, for example, aromatic hydrocarbon insulating oils.

BRIEF SUMMARY OF THE INVENTION

It is, therefore, the primary object of the present invention to provide an improved electrical insulating oil composition which is free from the above-described disadvantages in the conventional art.

Another object of the present invention is to provide an electrical insulating oil composition which scarcely deteriorates when brought into contact with lead or lead alloy materials.

A further object of the present invention is to provide an electrical insulating oil composition which can be prepared without difficulty at low cost.

In accordance with the present invention, the electrical insulating oil composition is characterized in that it contains 5 to 300 ppm (as sulfur) of sulfur compounds.

DETAILED DESCRIPTION OF THE INVENTION

The electrical insulating oils which are suitable for preparing the electrical insulating oil composition of the invention are mineral oils, polybutenes, alkylbenzenes, aromatic hydrocarbons having two to three aromatic nuclei, and other known electrical insulating oils. Amongst them, are the compounds having two to three aromatic nuclei are especially preferred.

The compounds having two aromatic nuclei are exemplified by alkane, cycloalkane or alkene-type compounds such as diarylalkanes, diarylcycloalkanes and diarylalkenes; biphenyl-type compounds such as biphenyl, alkylbiphenyls and cycloalkylbiphenyls; and condensed-type compounds such as naphthalene and alkylnaphthalenes.

Diarylalkanes are exemplified by diarylmethanes such as phenyltolylmethane and phenylxylylmethane; and diarylethanes such as 1-phenyl-1-methylphenylethane, 1-phenyl-1-dimethylphenylethane, 1-phenyl-1-ethylphenylethane, 1-phenyl-1-propylphenylethane, 1,1-bisethylphenylethane, 1-phenyl-2-methylphenylethane, 1-phenyl-2-dimethylphenylethane, 1-phenyl-2-ethylphenylethane, 1-phenyl-2-propylphenylethane, and 1,2-bisethylphenylethane.

Examples of diarylcycloalkanes include diphenylcyclohexane (trade mark: HB-40, made by Monsanto Co., U.S.A.), a saturated cyclic dimer of styrene such as 1-methyl-3-phenylindane and its alkyl derivatives. Examples of diarylalkenes are unsaturated linear dimers of styrene such as 1,3-diphenylbutene-1 and 1,3-diphenylbutene-2 and their alkyl derivatives.

These alkane-, cycloalkane- and alkene-type compounds can be represented by the following general formula (I) and (II):

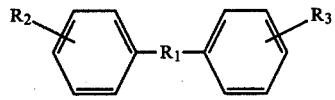

(I)

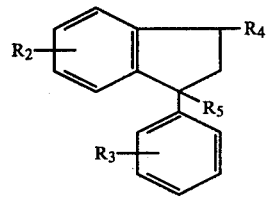

(II)

in which $R_1$ is a saturated or unsaturated, straight chain or branched aliphatic hydrocarbon group or alicyclic hydrocarbon group and each of $R_2$, $R_3$, $R_4$, and $R_5$ is a hydrogen atom or one or plurality of alkyl groups.

An example of alkylbiphenyl is mono- or diisopropyl biphenyl (trade mark: MIPB, made by The Tanatex Chem. Co., U.S.A.) and an example of cycloalkylbiphenyl is cyclohexylbiphenyl (trade mark: HB-40, made by Monsanto Co., U.S.A.) These biphenyl-type compounds are represented by the following general formula (III):

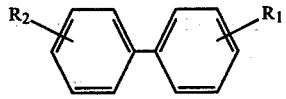

(III)

in which each of $R_1$ and $R_2$ is a hydrogen atom or one or plurality of alkyl groups or cycloalkyl groups.

The foregoing condensed-type compounds are exemplified by naphthalene and mono, di or triisopropylnaphthalene (trade mark: KIS-400, made by Kureha Chem. Ind. Co., Ltd., Japan) and represented by the following general formula (IV):

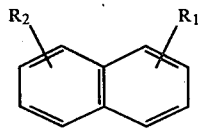

(IV)

in which each of $R_1$ and $R_2$ is a hydrogen atom or one or plurality of alkyl groups.

The compounds having three aromatic nuclei are, for example, triarylalkane such as diphenylxylylbutane represented by the following general formula (V); arylnaphthylalkanes such as phenylnaphthylethane represented by the following general formula (VI); and di(arylalkyl)benzene or di(arylalkyl)alkylbenzene such as distyrenated xylene (trade mark: HISOL SAS-LH, made by Nippon Petrochemicals Co., Ltd., Japan) and dibenzyltoluene (trade mark: MALOTHERM S, made by Chemische Werke Hüls A.G., W. Germany) represented by the following formula (VII):

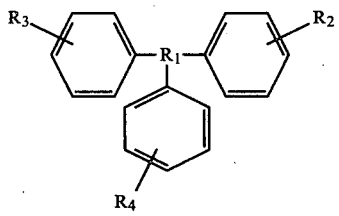

(V)

in which $R_1$ is a hydrocarbon group and each of $R_2$, $R_3$ and $R_4$ is a hydrogen atom or one or plurality of alkyl groups.

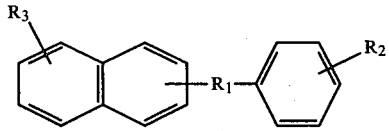

(VI)

in which $R_1$ is a hydrocarbon group and each of $R_2$ and $R_3$ is a hydrogen atom or one or plurality of alkyl groups.

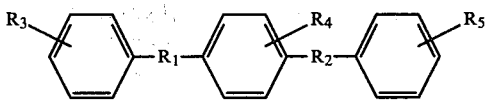

(VII)

in which $R_1$ and $R_2$ are hydrocarbon groups and each of $R_3$, $R_4$ and $R_5$ is a hydrogen atom or one or plurality of alkyl groups.

In the present invention, these compounds may be used either alone or in combination of two kinds or more.

The above-mentioned sulfur compound is obtained by treating a sulfur compound precursor of the above sulfur compound in the presence of an acid catalyst, which sulfur compound precursor is contained in a byproduct hydrocarbon fraction containing monocyclic aromatic compounds as main components. The byproduct hydrocarbon fraction is obtained in thermal cracking of petroleum hydrocarbons. This hydrocarbon fraction will hereinafter be referred to as "thermal cracking byproduct fraction".)

The above thermal cracking byproduct fraction is obtained as a byproduct fraction in the preparation of ethylene, propylene or the like by thermally cracking, at 700° C. or above, petroleum hydrocarbons such as crude oil, naphtha, kerosene, L.P.G., and butane and the byproduct fraction contains monocyclic aromatic hydrocarbons. Among the byproduct fractions, the one mainly containing the components within a boiling range between 75° C. and 198° C. is preferable. More preferable boiling range is 135° C. to 198° C. The above-mentioned sulfur compound precursor is contained in this thermal cracking byproduct fraction.

A preferable method to cause the electrical insulating oil composition of the present invention to contain the foregoing sulfur compound may be carried out as follows.

Without complete removal of the sulfur compound precursor in thermal cracking byproduct fraction, the byproduct fraction is treated in the presence of an acid catalyst to obtain an electrical insulating oil fraction containing, as main components, aromatic hydrocarbons having two to three aromatic nuclei. In this acid catalyst treating process, the sulfur compound precursor contained in the starting material of thermal cracking byproduct fraction becomes a heavier sulfur compound within the boiling range of the foregoing electrical insulating oil fraction. Since the sulfur compound is contained in this electrical insulating oil fraction, it can be used as the electrical insulating oil composition of the present invention as it stands or by adjusting suitably the boiling range thereof. In this case, the content of the above sulfur compound precursor in the thermal cracking byproduct fraction is preferably in the range of 5 to 500 ppm as sulfur. However, even when the sulfur content of the thermal cracking byproduct fraction exceeds 500 ppm, the electrical insulating oil composition of the present invention can be prepared by treating the byproduct fraction as described above and mixing the catalyst-treated product with another electrical insulating oil, thereby adjusting the content of the sulfur compound in the prepared insulating oil composition. Furthermore, it is possible to concentrate the sulfur compound contained in the above-mentioned electrical insulating oil fraction and to add the concentrate into some other electrical insulating oils, thereby preparing the electrical insulating oil composition of the present invention. Still further, it is also possible to concentrate or isolate the sulfur compound precursor from the thermal cracking byproduct fraction, to subject the sulfur compound precursor to the foregoing acid catalyst treatment obtaining the sulfur compound and to add the sulfur compound into an ordinary electrical insulating oil, thereby preparing the electrical insulating oil composition of the present invention.

Both the above-mentioned sulfur compound precursor and sulfur compound are organic compounds. Even though the chemical structure of the sulfur compound obtained by acid catalyst treatment of the sulfur compound precursor has not been clarified, it is quite apparent that the stability of an electrical insulating oil can be much improved by incorporating the above sulfur compound into the electrical insulating oil.

The contents of the sulfur compound precursor in the thermal cracking byproduct fraction and the sulfur compound in the electrical insulating oil composition of the invention are represented in terms of sulfur and are determined in accordance with JIS K 2541 (1980), "Test method for sulfur contents in crude oil and petroleum oil products".

In the case that the sulfur compound content is less than 5 ppm (as sulfur) in an electrical insulating oil composition, the lead resistant property becomes insufficient. Meanwhile, if the content exceeds 300 ppm (as sulfur), it is not desirable because some problems such as corrosion of electrical appliances are cause to occur.

In the following, the preparation of electrical insulating oil compositions with using starting materials of thermal cracking byproduct fractions will be described.

The thermal cracking byproduct fraction used for preparing the electrical insulating oil composition of the invention contains 5 to 100 mol of aromatic olefins relative to 100 mol of aromatic hydrocarbons other than the aromatic olefins and 5 to 500 ppm (as sulfur) of sulfur compound precursors. The thermal cracking byproduct fraction is subjected to liquid phase reaction in the presence of an acid catalyst in which the aromatic olefin content in the reaction system is adjusted to a value not more than 5 wt.%. The material obtained through the reaction contains reaction products of non-condensed-type di- to tri-cyclic aromatic hydrocarbons and 5 to 300 ppm (as sulfur) of the sulfur compound.

The composition of this thermal cracking byproduct fraction differs according to the petroleum hydrocarbon which was used for thermal cracking. The thermal cracking byproduct fraction generally contains the main components of monocyclic aromatics having 6 to 10 carbon atoms, 5 to 15 wt.% of saturated aliphatic hydrocarbons, 2 to 10 wt.% of unsaturated aliphatic hydrocarbons, 2 to 15 wt.% of aromatic olefins, and in addition, 5 to 500 ppm (as sulfur) of the above-mentioned sulfur compound precursor. This fraction as it stands can be used as the starting material in the present invention. Further, the byproduct fraction may be mixed with a similar component which is obtained by isolation or synthesis. Furthermore, the starting material for preparing the insulating oil composition of the invention may also be prepared by adding other components included in the same boiling range and obtained by thermal cracking of petroleum hydrocarbons to catalytic reforming fractions within the same boiling range, and making the composition thereof the same as the foregoing composition of the thermal cracking byproduct fraction.

Among components within the boiling range of 75° C. to 198° C. that are obtained by thermally cracking petroleum hydrocarbons at a temperature of 700° C. or above, monocyclic aromatic components such as benzene, toluene, xylene, cumene, propylbenzene, methylethylbenzene, trimethylbenzene, diethylbenzene, and tetramethylbenzene are considered to react with other components of aromatic olefins in the presence of acid catalyst to produce heavier components within the boiling range of 265° C. to 360° C. (at normal pressure) that are useful as electrical insulating oils. These heavier components are several kinds of aromatic hydrocarbons. Further, it is preferable for the electrical insulating oil composition of the present invention that the heavier products having two to three aromatic nuclei and the sulfur compound exist in the composition, which components are obtained by using the starting hydrocarbon mixture containing the sulfur compound precursor and aromatic olefins such as styrene, methylstyrene, and ethylstyrene. More preferable fraction has a boiling range of 285° C. to 315° C. and contains reaction product having two aromatic nuclei and the sulfur compound.

The content of aromatic olefins in the starting hydrocarbon mixture is not especially restricted, however, the ratio of 5 to 100 mol of aromatic olefins relative to 100 mol of aromatic hydrocarbons other than the aromatic olefins is preferable. In the case that the above ratio is less than 5 mol, the obtainable quantity of the electrical insulating oil fraction becomes small, while if the ratio exceeds 100 mol, the production of unsaturated polymers of the aromatic olefins becomes large, which polymers come into the electrical insulating oil fraction to worsen its properties.

The starting hydrocarbon mixture does not contain components having boiling ranges above 200° C. In the thermal cracking product of petroleum hydrocarbons, components having boiling points above 200° C. are condensed polycyclic aromatic hydrocarbons such as naphthalene, alkylnaphthalene and anthracene. These condensed polycyclic aromatic hydrocarbons have many alkylation-active carbon atoms. It is not desirable to use such aromatic hydrocarbons as starting material in the present invention because the yield of electrical insulating oil composition of the invention is reduced due to the heavier products produced. Also, the fraction having a boiling point below 75° C. which is obtained through the thermal cracking of petroleum hydrocarbons, contains a large amount of dienes such as cyclopentadiene. If dienes are contained in the starting material, polymerization of the dienes results thereby producing highly viscous products which inhibits the reaction of the acid catalyst, thereby the yield of electrical insulating oil composition is seriously reduced.

As described above, it is preferable that the starting hydrocarbon fraction contains 5 to 500 ppm of the sulfur compound precursor. The starting hydrocarbon fraction is used for the next acid catalyst treating step without completely removing such a sulfur compound precursor.

The acid catalysts preferably employed in the present invention are solid acid catalysts, mineral acids and Friedel-Crafts catalysts, which are exemplified by clay minerals such as acid clay and activated clay, silica-alumina, hydrogen fluoride, sulfuric acid, phosphoric acid, aluminum chloride, tin chloride, and boron fluoride.

More particularly, as preferred examples of the solid acid catalysts are mentioned natural clay minerals. Typical clay minerals are kaolinitic halloysite clay minerals and montmorillonite clay minerals, which are known as acid clay and subbentonite. Also usable ones are activated clays that are obtained by treating these clay minerals with inorganic acids such as sulfuric acid and hydrochloric acid or organic acids such as acetic acid and formic acid, or with their aqueous solutions. A particularly preferable catalyst is the synthetic silica-alumina (alumina content: 20–50 wt.%, calcined at 450°–700° C.). Inorganic acids such as sulfuric acid, phosphoric acid and hydrogen fluoride may also be used, however, care must be taken to prevent the reaction apparatus from corroding.

It is necessary that the treatment with an acid catalyst be carried out with maintaining the thermal cracking byproduct fraction in liquid phase. Accordingly, the reaction pressure will be at a value to maintain the thermal cracking byproduct fraction in liquid phase at a temperature in the range of 0° to 200° C.

In the preparation of the composition of the present invention, the reaction temperature is also one of important factors. Below 0° C., undesirable tarry substances will be produced due to polymerization of aromatic olefins in the thermal cracking byproduct fraction and will reduce the yield of insulating oil. At a temperature above 200° C., the thermal decomposition of the reaction mixture will cause the deterioration of the insulating oil fraction. The reaction temperature employed will vary depending upon the catalyst employed. Preferred temperatures are above 100° C. for the solid acid catalyst and below 100° C. for the mineral acids and Friedel-Crafts catalysts.

The liquid residence time is preferably from 0.1 to 5 hours. The period of time less than 0.1 hour wil not complete the reaction of unsaturated components, mainly aromatic olefins contained in the starting hydrocarbon mixture, thereby undesirably reducing the yield of the useful electrical insulating oil composition. On the other hand, the contact with the acid catalyst for a period longer than 5 hours is not desirable because it will cause decomposition of reaction products to increase unsaturated components which are undesirable for the electrical insulating oil composition and exerts a bad influence upon the properties of obtained electrical insulating oil composition.

In order to produce the electrical insulating oil fraction in a high yield, it is preferable that the concentration of aromatic olefins in the reaction system is not more than 5 wt.%. Too high concentration of the aromatic olefins and other unsaturated components in the reaction system will increase the formation of heavier tarry substance with polymerization of the unsaturated components and badly reduce the yield of insulating oil fraction. In addition, the produced unsaturated polymer is mixed in the electrical insulating oil composition to degrade the properties of the electrical insulating oil composition. Since the content of aromatic olefins in the thermal cracking byproduct fraction within the above-mentioned boiling range is usually more than 5 wt.%, in practical operations, it is desirable that the concentration of unsaturated components be adjusted by recycling the reaction product or a distilled fraction.

Among reaction products from acid catalyst treatment of the starting hydrocarbon mixture, the fraction within a boiling range of 265° C. to 360° C. (at normal pressure) containing 5 to 300 ppm (as sulfur) of sulfur compound can be used as the electrical insulating oil composition of the present invention. The components of this fraction within the above boiling range are considered to be the foregoing diarylalkanes, diarylcycloalkanes, diarylalkenes, heavier aromatic hydrocarbons represented by the foregoing general formulae (V) and (VII), and sulfur compounds that are produced by acid catalyst treatment of the starting hydrocarbon mixture. This electrical insulating oil composition has excellent characteristics as compared with any of conventional electrical insulating oils of mineral oils and aromatic hydrocarbons such as alkylbenzenes, diarylalkanes and alkylnaphthalenes. The insulating oil composition of the invention has a special advantage in that it exerts excellent deterioration resistance in the presence of lead substances.

The fraction containing components with boiling points higher than 360° C. obtained from the reaction product is so viscous that the impregnating property thereof for electric capacitors, transformers and pipe-type oil-filled cables is poor, which fact causes the formation of residual fine voids and dielectric breakdown of electrical appliances. Furthermore, the high boiling fraction is worse in low temperature fluidity which consequently worsens the starting characteristic at low temperatures of electrical appliances, so that it is not desirable for the electrical insulating oil composition. On the other hand, components with boiling points below 265° C. have lower flash points so that they are not desirable in view of the safety in the manufacturing of electrical appliances. An especially preferable reaction product is a fraction having a boiling range of 285° C. to 315° C., consisting of dicyclic aromatic hydrocarbons and containing 5 to 300 ppm (as sulfur) of sulfur compounds.

The insulating oil fraction obtained through the acid catalyst reaction may be refined by clay treatment, if desired. It should be noted, however, that the refining treatment to reduce the content of sulfur compounds below 5 ppm must be avoided.

The present invention will further be described with reference to examples and comparative examples.

(A) Preparation of Electrical Insulating Oil Compositions Electrical Insulating Oil Composition (I)

A xylene fraction containing styrene and having distilling temperatures of 135° C. to 145° C. was obtained by distillation of the byproduct oil in the thermal cracking process of naphtha. The composition of the xylene fraction was as follows:

| | |
|---|---|
| Non-aromatics | 4% |
| Xylenes (including ethylbenzene) | 67% |
| Styrene | 29% |
| Sulfur content | 100 ppm |

To 1 part by weight of this fraction was added 3 parts by weight of xylene and the obtained mixture was subjected to reaction in the presence of a synthetic silica-alumina catalyst at a feed rate of 250 ml/hr, reaction temperature of 150° C. and pressure of 5 $Kg/cm^2 \cdot G$. The catalyst employed was prepared by calcining synthetic silica-alumina containing 40 wt.% of alumina at 550° C. for 8 hours. In the reaction, a part of reaction effluent was so recycled that the styrene concentration in the reactor was adjusted to a level not higher than 5 wt.%. After the reaction, Electrical Insulating Oil Composition (I) with a boiling range of 285° C. to 315° C. was obtained from the reaction product by distillation. The content of sulfur compounds in this Composition (I) was 80 ppm as sulfur.

Electrical Insulating Oil Composition (II)

A xylene fraction containing styrene and having distilling temperature of 135° C. to 145° C. was obtained by distillation of the byproduct oil in the thermal cracking process of another kind of naphtha. The composition of the xylene fraction was as follows:

| | |
|---|---|
| Non-aromatics | 3% |
| Xylenes (including ethylbenzene) | 59% |
| Styrene | 38% |
| Sulfur content | 200 ppm |

To 1 part by weight of this fraction was added 3.5 parts by weight of xylene and the obtained mixture was subjected to the same reaction as the foregoing preparation of Composition (I), thereby obtaining Electrical Insulating Oil Composition (II). The content of sulfur compounds in this Composition (II) was 200 ppm as sulfur.

Electrical Insulating Oil Compositions (III) and (IV)

A xylene fraction containing styrene and having distilling temperature of 135° C. to 145° C. was obtained by distillation of the byproduct oil in the thermal cracking process of a still other kind of naphtha. The composition of the xylene fraction was as follows:

| | |
|---|---|
| Non-aromatics | 3% |
| Xylenes (including ethylbenzene) | 54% |
| Styrene | 43% |
| Sulfur content | 750 ppm |

To 1 part by weight of this fraction was added 4.5 parts by weight of xylene and the obtained mixture was subjected to the same reaction as the foregoing preparation of Composition (I) to obtain Reaction Product A. The content of sulfur compounds in this Reaction Product A was 650 ppm as sulfur.

Electrical Insulating Oil Composition (III) was prepared by mixing 1 part by weight of this Reaction Product A with 19 parts by weight of 1-phenyl-1-(3,4-dimethylphenyl)ethane (hereinafter referred to as "phenylxylylethane").

Further, Electrical Insulating Oil Composition (IV) was prepared by mixing 1 part by weight of the Reaction Product A with 9 parts by weight of monoisopropylbiphenyl (hereinafter referred to as "MIPB"). Incidentally, the above phenyl xylylethane and MIPB contain no sulfur compound.

(B) Test of Insulating Oils

Comparative tests in electrical characteristics were carried out with regard to Electrical Insulating Oil Compositions (I) to (IV) of the present invention and insulating oils of phenylxylylethane and MIPB as comparative examples.

In the test, a lead plate was immersed in a certain quantity of each insulating oil for 1 week at 115° C. in nitrogen gas (Condition A) and for 1 week at 115° C. in the air (Condition B) to test the degree of deterioration of each insulating oil. In both conditions, the contact area between a lead plate and an insulating oil was 16–18 $cm^2$/300 ml of insulating oil.

After the immersion, electrical characteristics of each insulating oil were measured. The conditions in the measurement were as follows:

| | |
|---|---|
| Dielectric loss tangent (tan δ) | 80° C., AC 1000 V (50 Hz) |
| Volume resistivity (ρ) | 80° C., DC 250 V |

The results of the above tests are shown in the following table.

It will be understood from the table that Electrical Insulating Oil Compositions (I) to (IV) (Test Nos. 1 to 8) are superior to the comparative examples (Test Nos. 9 to 12) in view of the electrical properties after immersion.

TABLE

| | | | Before Immersion | | After Immersion | |
|---|---|---|---|---|---|---|
| Test Number | Electrical Insulating Oil | Immersion Condition | Dielectric Loss Tangent (tan δ) %, 80° C. | Volume Resistivity (ρ) Ωmc, 80° C. | Dielectric Loss Tangent (tan δ) %, 80° C. | Volume Resistivity (ρ) Ωcm, 80° C. |
| 1 | Insulating Oil Comp. (I) | A | 0.01 | $1 \times 10^{16}$ | 0.01 | $2 \times 10^{15}$ |
| 2 | Insulating Oil Comp. (I) | B | " | " | 5.4 | $9 \times 10^{11}$ |
| 3 | Insulating Oil Comp. (II) | A | " | " | 0.03 | $2 \times 10^{15}$ |
| 4 | Insulating Oil Comp. (II) | B | " | " | 6.3 | $7 \times 10^{11}$ |
| 5 | Insulating Oil Comp. (III) | A | " | " | 0.02 | $4 \times 10^{15}$ |
| 6 | Insulating Oil Comp. (III) | B | " | " | 3.9 | $2 \times 10^{12}$ |
| 7 | Insulating Oil Comp. (IV) | A | 0.02 | $3 \times 10^{14}$ | 0.15 | $2 \times 10^{14}$ |
| 8 | Insulating Oil Comp. (IV) | B | " | " | 8.2 | $5 \times 10^{11}$ |
| 9 | Phenylxylyl-ethane | A | 0.01 | $1 \times 10^{16}$ | 0.81 | $1 \times 10^{14}$ |
| 10 | Phenylxylyl-ethane | B | " | " | 12+* | $5 \times 10^{11}$ |
| 11 | MIPB | A | 0.02 | $2 \times 10^{14}$ | 1.3 | $7 \times 10^{13}$ |
| 12 | " | B | " | " | 12+* | $3 \times 10^{11}$ |

Note *"12+" means "larger than 12".

What is claimed is:

1. An electrical insulating oil composition which is resistant to deterioration caused by contact with lead and lead alloys consisting essentially of aromatic hydrocarbons having two to three aromatic nuclei and sulfur compounds in an amount sufficient to provide 5 to 300 ppm as sulfur, said sulfur compounds obtained by treating in the presence of an acid catalyst a liquid phase hydrocarbon by-product fraction derived from the thermal cracking of petroleum hydrocarbons at a temperature of at least 700° C. and principally composed of components with a boiling range of between about 75° C. and about 198° C., said acid catalyst treated hydrocarbon by-product fraction having a boiling range of between 265° C. and 360° C. and combined with said aromatic hydrocarbons whereby said sulfur concentration is adjusted to 5 to 300 ppm as sulfur.

2. The electrical insulating oil composition of claim 1 wherein said aromatic hydrocarbons are diarylalkanes.

3. A process for preparing said acid catalyst treated hydrocarbon by-product fraction as claimed in claim 1 which comprises:

a. thermal cracking petroleum hydrocarbons under reaction conditions effective to obtain a hydrocarbon by-product fraction having a boiling range of from about 75° C. to about 198° C., 5 to 100 moles of aromatic olefins relative to 100 moles of aromatic hydrocarbons other than said aromatic olefins, and 5 to 500 ppm (as sulfur) of sulfur compounds as the precursors of said sulfur compounds; and b. contacting the hydrocarbon by-product fraction in liquid phase with an acid catalyst, the contents of aromatic olefins being no more than 5 weight % of the reaction system and the temperature of reaction being in the range of about 0° C. to about 200° C.

4. In the art of providing electrical insulating oil compositions of primarily aromatic hydrocarbons the improvement comprising imparting to such composition resistance to deterioration caused by contact with lead or lead alloys consisting essentially of combining with said compositions the acid catalyst treated hydrocarbon by-product fraction of claim 3 containing sulfur compounds in an amount sufficient to provide 5 to 300 ppm as sulfur.

* * * * *